US006655372B1

(12) United States Patent
Field et al.

(10) Patent No.: US 6,655,372 B1
(45) Date of Patent: Dec. 2, 2003

(54) QUICK DETACHABLE GUN BARREL ASSEMBLY

(76) Inventors: Damion J. Field, 3509 Webster Rd., Fredonia, NY (US) 14063; Richard A. Prince, 3509 Webster Rd., Fredonia, NY (US) 14063

( * ) Notice: Subject to any disclaimer, the term of this patent is extended or adjusted under 35 U.S.C. 154(b) by 0 days.

(21) Appl. No.: 10/123,468

(22) Filed: Apr. 17, 2002

(51) Int. Cl.[7] ..... F41B 11/00
(52) U.S. Cl. ..... 124/83; 42/75.02
(58) Field of Search ..... 124/73, 74, 83, 124/84; 42/75.02

(56) References Cited

U.S. PATENT DOCUMENTS 2,345,127 A * 3/1944 Kehne
2,853,133 A * 9/1958 Norman et al.
5,433,133 A * 7/1995 LaFrance
5,630,406 A * 5/1997 Dumont
5,685,102 A * 11/1997 Latka
5,706,599 A * 1/1998 Knight
6,273,080 B1 * 8/2001 Sullivan

* cited by examiner

*Primary Examiner*—John A. Ricci

(57) ABSTRACT

A quick detachable gun barrel assembly for allowing a user to repair one's gun more quickly and easily when needed. The quick detachable gun barrel assembly includes a barrel coupling assembly being adapted to removably attach to a chamber of a gun; and also includes an elongate barrel member being detachably attached to the barrel coupling assembly.

8 Claims, 1 Drawing Sheet

QUICK DETACHABLE GUN BARREL ASSEMBLY

BACKGROUND OF THE INVENTION

1. Field of the Invention

The present invention relates to paint gun detachable barrels and more particularly pertains to a new quick detachable gun barrel assembly for allowing a user to repair one's gun more quickly and easily when needed.

2. Description of the Prior Art

The use of paint gun detachable barrels is known in the prior art. More specifically, paint gun detachable barrels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,228,427; U.S. Pat. No. 5,433,133; U.S. Pat. No. 5,685,102; U.S. Pat. No. 5,020,260; U.S. Pat. No. 5,410,834; and U.S. Pat. No. Des. 353,853.

While these devices fulfill their respective, particular objectives and requirements, the aforementioned patents do not disclose a new quick detachable gun barrel assembly. The prior art discloses inventions having complex components with the adapter having a spring.

SUMMARY OF THE INVENTION

The general purpose of the present invention, which will be described subsequently in greater detail, is to provide a new quick detachable gun barrel assembly which has many of the advantages of the paint gun detachable barrels mentioned heretofore and many novel features that result in a new quick detachable gun barrel assembly which is not anticipated, rendered obvious, suggested, or even implied by any of the prior art paint gun detachable barrels, either alone or in any combination thereof. The present invention includes a barrel coupling assembly being adapted to removably attach to a chamber of a gun; and also includes an elongate barrel member being detachably attached to the barrel coupling assembly. None of the prior art discloses essentially a two-piece set which includes the elongate barrel member for quickly and conveniently attaching the elongate barrel member to the paint gun.

There has thus been outlined, rather broadly, the more important features of the quick detachable gun barrel assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present-invention to provide a new quick detachable gun barrel assembly which has many of the advantages of the paint gun detachable barrels mentioned heretofore and many novel features that result in a new quick detachable gun barrel assembly which is not anticipated, rendered obvious, suggested, or even implied by any of the prior art paint gun detachable barrels, either alone or in any combination thereof.

Still another object of the present invention is to provide a new quick detachable gun barrel assembly for allowing a user to repair one's gun more quickly and easily when needed.

Still yet another object of the present invention is to provide a new quick detachable gun barrel assembly that saves the user time and effort in repairing one's gun.

Even still another object of the present invention is to provide a new quick detachable gun barrel assembly that allows the user to easily unclog the barrel of the gun.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
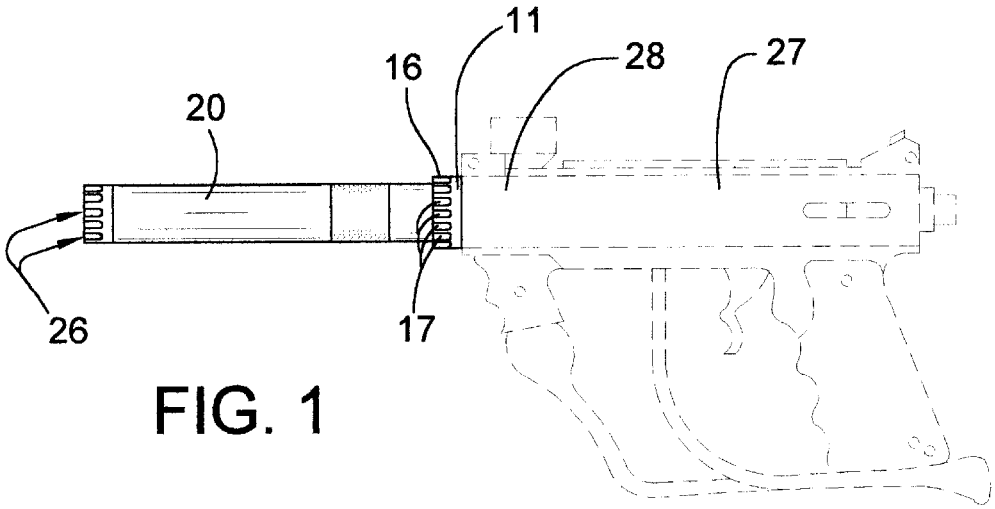
FIG. 1 is a side elevational view of a new quick detachable gun barrel assembly according to the present invention and shown in use.
Figure 2:
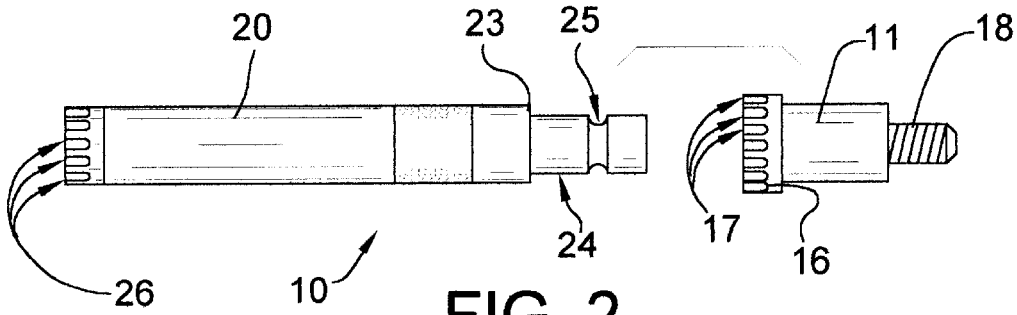
FIG. 2 is an exploded side elevational view of the present invention.
Figure 3:
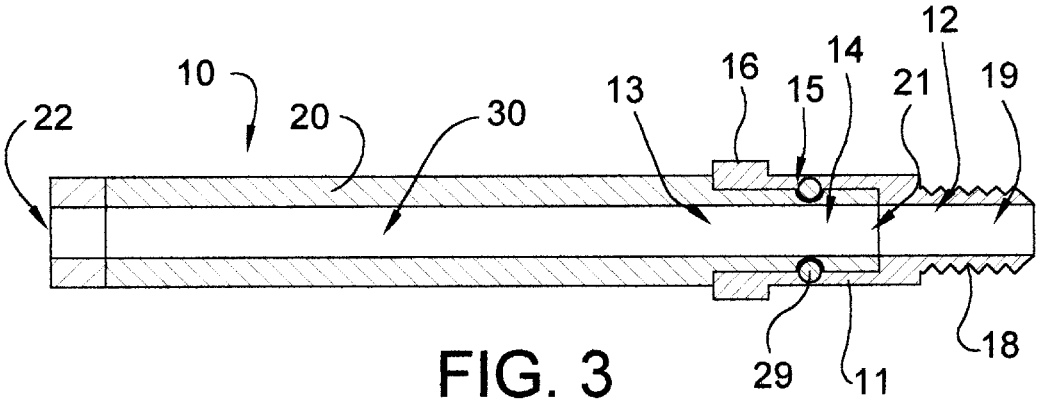
FIG. 3 is a cross-sectional view of the present invention.

With reference now to the drawings, and in particular to FIGS. 1 through 3 thereof, a new quick detachable gun barrel assembly embodying the principles and concepts of the present invention and generally designated by the reference numeral 10 will be described.

As best illustrated in FIGS. 1 through 3, the quick detachable gun barrel assembly 10 generally comprises a barrel coupling assembly being adapted to removably attach to a chamber 28 of a gun 27, in particular, a paint gun. The barrel coupling assembly includes a tubular main portion 11, and also includes a collar 16 being conventionally attached about the tubular main portion 11, and further includes a threaded shaft 18 being conventionally attached to the tubular main portion 11 and being adapted to thread into the chamber 28 the gun 27, and also includes a retainer ring 29 being conventionally disposed in the tubular main portion 11. The tubular main portion 11 has open first and second ends 12,13 and a bore 14 extending therethrough and being defined by a wall which has an annular groove 15 disposed therein. The collar 16 is conventionally disposed near the second end 13 of the tubular main portion 11 and has a plurality of notches 17 being circumferentially-spaced about and being disposed in an exterior of a wall thereof for allowing a user to easily grasps the collar 16 with one's fingers. The threaded shaft 18 has a bore 19 extending therethrough and which is in alignment with the bore 14 of the tubular main portion 11. The shaft 18 is conventionally attached at the open first end 12 of the tubular main portion 11. The retainer ring 29 is seated-in the annular groove 15.

An elongate barrel member 20 is detachably attached to the barrel coupling assembly. The elongate barrel member 20 has open first and second ends 21,22, and also has a bore 30 extending therethrough, and further has a first end portion 23 which is securely and removably received in the bore 14 of the tubular main portion 11 through the open second end 13 thereof. The first end portion 23 of the elongate barrel member 20 has an annular recessed portion 24 and has an annular channel 25 being disposed in an exterior of a wall of the annular recessed portion 24 and removably receiving the retainer ring 29 upon the first end portion 23 of the elongate barrel member 20 being securely received in the tubular main portion 11. The elongate barrel member 20 further includes a plurality of notches 26 being circumferentially-spaced about and being disposed in an exterior of a wall of the elongate barrel member 20 at the second end 22 thereof.

In use, the user would thread the shaft 18 into the open end of the chamber 28 of the paint gun 27, and would then insert the first end portion 23 of the elongate barrel member 20 into the open second end 13 of the tubular main portion 11 until the retainer ring 29 is seated in the annular channel 25 of the annular recessed portion 24 of the elongate barrel member 20. To remove the elongate barrel member 20, the user simply grasps the elongate barrel member 20 and pulls it out of the tubular main portion 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the quick detachable gun barrel assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A quick detachable gun barrel assembly comprising:

a barrel coupling assembly being adapted to removably attach to a chamber of a gun, said barrel coupling assembly including a tubular main portion, and also including a collar being attached about said tubular main portion, and further including a threaded shaft being attached to said tubular main portion and being adapted to thread into the chamber of the gun, and also including a retainer ring being disposed in said tubular main portion; and an elongate barrel member being detachably attached to said barrel coupling assembly.

2. A quick detachable gun barrel assembly as described in claim 1, wherein said tubular main portion has open first and second ends and a bore extending therethrough and being defined by a wall which has an annular groove disposed therein.

3. A quick detachable gun barrel assembly as described in claim 2, wherein said collar is disposed near said second end of said tubular main portion and has a plurality of notches being circumferentially-spaced about and disposed in an exterior of a wall thereof for allowing a user to easily grasps said collar with one's fingers.

4. A quick detachable gun barrel assembly as described in claim 2, wherein said retainer ring is seated in said annular groove.

5. A quick detachable gun barrel assembly as described in claim 1, wherein said threaded shaft has a bore extending therethrough and which is in alignment with said bore of said tubular main portion, said shaft being attached at said open first end of said tubular main portion.

6. A quick detachable gun barrel assembly as described in claim 4, wherein said elongate barrel member has open first and second ends, and also has a bore extending therethrough, and further has a first end portion which is securely and removably received in said bore of said tubular main portion through said open second end thereof.

7. A quick detachable gun barrel assembly as described in claim 6, wherein said first end portion of said elongate barrel member has an annular recessed portion and has an annular channel being disposed in an exterior of a wall of said annular recessed portion and removably receiving said retainer ring upon said first end portion of said elongate barrel member being securely received in said tubular main portion.

8. A quick detachable gun barrel assembly as described in claim 7, wherein said elongate barrel member further includes a plurality of notches being circumferentially-spaced about and being disposed in an exterior of a wall of said elongate barrel member at said second end thereof.

* * * * *